US009966161B2

(12) United States Patent
Shu et al.

(10) Patent No.: US 9,966,161 B2
(45) Date of Patent: May 8, 2018

(54) MECHANICAL DESIGN OF THIN-FILM DIAMOND CRYSTAL MOUNTING APPARATUS WITH OPTIMIZED THERMAL CONTACT AND CRYSTAL STRAIN FOR COHERENCE PRESERVATION X-RAY OPTICS

(71) Applicant: UChicago Argonne, LLC, Chicago, IL (US)

(72) Inventors: Deming Shu, Darien, IL (US); Yury Shvydko, Lisle, IL (US); Stanislav Stoupin, Willowbrook, IL (US); Kwang-Je Kim, Burr Ridge, IL (US)

(73) Assignee: UChicago Argonne, LLC, Chicago, IL (US)

( * ) Notice: Subject to any disclaimer, the term of this patent is extended or adjusted under 35 U.S.C. 154(b) by 48 days.

(21) Appl. No.: 14/859,697

(22) Filed: Sep. 21, 2015

(65) Prior Publication Data

US 2017/0085055 A1 Mar. 23, 2017

(51) Int. Cl.
*G21K 1/06* (2006.01)
*H05G 1/00* (2006.01)

(52) U.S. Cl.
CPC *G21K 1/06* (2013.01); *H05G 1/00* (2013.01)

(58) Field of Classification Search
CPC .... H01S 4/00; G01N 23/20; G01N 23/20008; G21K 1/06
USPC ..... 378/204, 205, 208, 82, 84
See application file for complete search history.

(56) References Cited

U.S. PATENT DOCUMENTS 4,602,377 A * 7/1986 Schiferl ..... G21K 1/02 378/150
4,776,223 A * 10/1988 Moss ..... G01N 21/0317 356/244
4,822,466 A * 4/1989 Rabalais ..... C30B 23/02 204/192.15
5,113,661 A * 5/1992 Deeks ..... H02J 15/00 204/155
5,295,402 A * 3/1994 Bovenkerk ..... B01J 3/065 425/77

(Continued)

OTHER PUBLICATIONS

I. Kantor et al., "BX90: A new diamond anvil cell design for X-ray diffraction and optical measurements," Review of Scientific Instruments 83, 125102 (2012).*

(Continued)

*Primary Examiner* — Allen C. Ho
(74) *Attorney, Agent, or Firm* — Joan Pennington

(57) ABSTRACT

A method and mechanical design for a thin-film diamond crystal mounting apparatus for coherence preservation x-ray optics with optimized thermal contact and minimized crystal strain are provided. The novel thin-film diamond crystal mounting apparatus mounts a thin-film diamond crystal supported by a thick chemical vapor deposition (CVD) diamond film spacer with a thickness slightly thicker than the thin-film diamond crystal, and two groups of thin film thermal conductors, such as thin CVD diamond film thermal conductor groups separated by the thick CVD diamond spacer. The two groups of thin CVD film thermal conductors provide thermal conducting interface media with the thin-film diamond crystal. A piezoelectric actuator is integrated into a flexural clamping mechanism generating clamping force from zero to an optimal level.

18 Claims, 9 Drawing Sheets

(56) References Cited

U.S. PATENT DOCUMENTS 5,509,043 A * 4/1996 Van Der Sluis ..... G21K 1/06 378/70
5,524,040 A * 6/1996 Alp ..... G21K 1/06 378/84
5,693,345 A * 12/1997 Chen ..... G01N 23/20041 264/319
6,082,200 A * 7/2000 Aslam ..... G01L 1/18 73/774
6,456,688 B1 * 9/2002 Taguchi ..... G21K 1/06 378/79
6,543,295 B2 * 4/2003 Xu ..... G01N 21/0317 73/818
6,574,306 B2 * 6/2003 Kikuchi ..... G21K 1/06 378/145
6,582,513 B1 * 6/2003 Linares ..... C30B 25/02 117/93
6,607,840 B2 8/2003 Shu et al.
6,807,251 B2 * 10/2004 Okanda ..... G01N 23/20 378/71
6,822,733 B1 11/2004 Shu et al.
6,858,080 B2 * 2/2005 Linares ..... C30B 25/02 117/104
6,885,726 B2 * 4/2005 Uehara ..... G01N 23/223 378/145
6,917,667 B2 * 7/2005 Fujinawa ..... G21K 1/06 378/70
6,947,518 B2 * 9/2005 Itoga ..... G03F 7/70008 378/34
6,984,335 B2 1/2006 Shu et al.
7,099,437 B2 * 8/2006 Pike ..... G01N 23/202 378/70
7,162,888 B2 1/2007 Shu et al.
7,314,540 B2 * 1/2008 Seki ..... C02F 1/46109 204/294
7,332,727 B2 * 2/2008 Kawashima ..... B23K 26/0732 250/458.1
7,390,695 B2 * 6/2008 Meguro ..... C30B 25/02 257/E21.041
7,396,408 B2 * 7/2008 Schreck ..... C30B 25/105 117/68
7,508,912 B2 * 3/2009 Zhong ..... G21K 1/06 378/84
7,579,759 B2 * 8/2009 Lee ..... H03H 9/02582 310/313 R
7,581,403 B2 * 9/2009 Deeks ..... H02J 15/00 205/155
7,594,968 B2 * 9/2009 Hemley ..... C23C 16/274 117/106
7,597,475 B1 10/2009 Shu et al.
7,736,472 B2 * 6/2010 Kawashima ..... B23K 26/0732 117/200
7,738,630 B2 * 6/2010 Burdett, Jr. ..... B82Y 10/00 378/84
7,791,291 B2 * 9/2010 Gorrell ..... H01J 25/00 315/501
7,799,599 B1 * 9/2010 Sung ..... H01L 21/02381 257/352
7,820,131 B2 * 10/2010 Hemley ..... C30B 25/105 117/88
7,848,489 B1 * 12/2010 He ..... G01N 23/207 378/71
7,883,684 B2 * 2/2011 Hemley ..... C23C 16/274 117/103
7,892,356 B2 * 2/2011 Meguro ..... C23C 16/274 117/101
8,076,034 B1 * 12/2011 Lassila ..... B82Y 30/00 423/648.1
8,089,199 B2 1/2012 Shu et al.
8,119,241 B2 * 2/2012 Ueda ..... C30B 25/02 117/88
8,126,117 B2 * 2/2012 Verman ..... B82Y 10/00 378/135
8,455,048 B1 * 6/2013 Fan ..... B82Y 30/00 427/240
8,559,597 B2 * 10/2013 Chen ..... G01N 23/223 378/85
8,724,776 B2 * 5/2014 Haas ..... G21K 1/06 378/204
8,810,904 B2 * 8/2014 Jacobsen ..... G01B 17/02 356/450
8,957,567 B2 2/2015 Shu et al.
9,008,272 B2 4/2015 Shu et al.
9,133,566 B2 * 9/2015 Twitchen ..... C30B 25/105
9,180,420 B1 * 11/2015 Fan ..... B01J 8/00
9,194,824 B1 * 11/2015 Qian ..... G01N 21/0317
9,217,207 B2 * 12/2015 Chang ..... C30B 25/183
9,269,468 B2 * 2/2016 Ryan ..... G21K 1/06
9,469,918 B2 * 10/2016 Xu ..... C30B 25/02
9,484,178 B2 * 11/2016 Yamada ..... H01J 35/08
9,529,098 B2 * 12/2016 Stoupin ..... G01T 1/26
9,613,729 B2 * 4/2017 Shu ..... G21K 7/00

OTHER PUBLICATIONS

Ronald Miletich, "Types of Diamond-Anvil Cells and how to work with them," ECM-27 High-P Workshop Methods of high-P single crystal x-ray diffraction. Aug. 2012.*
A. Jayaraman, Review of Modern Physics, vol. 55, No. 1, Jan. 1983, pp. 65-108.*
K.-J. Kim and Y. Shvyd'ko, "Tunable optical cavity for an x-ray free-electron-laser oscillator", Phys. Rev. ST-AB 12, 030703, 2009.
J. Amann, et al., "Demonstration of self-seeding in a hard-X-ray free-electron laser", Nature Photonics DOI:10.1038-180, 2012.
S. Stoupin, et al., "Hybrid diamond-silicon angular-dispersive x-ray monochromator with 0.25-meV energy bandwidth and high spectral efficiency", Optics Express vol. 21 Issue 25, pp. 30932-30946, 2013.
Y. P. Stetsko and et al., "Time-delayed beam splitting with energy separation of x-ray channels", Appl. Phys. Lett. 103, 173508,2013.
S. Stoupin, et al., "Diamond crystal optics for self-seeding of hard-X-rays in X-ray free-electron lasers", Diamond & Related Materials 33, 1-4, 2013.
D. Shu, et al., "Design of a diamond-crystal monochromator for the LCLS hard x-ray self-seeding project", J. Phys. Conf. Ser. 425 052004, 2013.
S. Stoupin, et al., "All-diamond optical assemblies for a beam-multiplexing X-ray monochromator at the Linac Coherent Light Source", J. Appl. Cryst. 47, 1329-1336, 2014.
D. Zhu et al., "Performance of beam-multiplexing diamond crystal monochromator at the Linac Coherent Light Source", Rev. Sci. Instrum. 85, 063106, 2014.

* cited by examiner

PRIOR ART

PRIOR ART

MECHANICAL DESIGN OF THIN-FILM DIAMOND CRYSTAL MOUNTING APPARATUS WITH OPTIMIZED THERMAL CONTACT AND CRYSTAL STRAIN FOR COHERENCE PRESERVATION X-RAY OPTICS

CONTRACTUAL ORIGIN OF THE INVENTION

The United States Government has rights in this invention pursuant to Contract No. DE-AC02-06CH11357 between the United States Government and UChicago Argonne, LLC representing Argonne National Laboratory.

FIELD OF THE INVENTION

The present invention relates generally to thin-film diamond mounting apparatus, and more particularly, relates to a method and mechanical design for thin-film diamond crystal mounting apparatus for coherence preservation x-ray optics with optimized thermal contact and minimized crystal strain.

DESCRIPTION OF THE RELATED ART

Thin-film type-IIa high-pressure high-temperature (HPHT) synthetic diamond-crystals have widespread applications in the field of x-ray optics, such as x-ray optics cavities for hard x-ray free-electron laser oscillators (XFELOs), self-seeding monochromators for hard x-ray free-electron laser (XFEL), ultra-high resolution diamond crystal monochromators/analyzers, beam-sharing, and beam-split-and-delay devices for XFEL and synchrotron radiation facilities. In many cases, the required thickness of the diamond crystals could be in the range of 30-120 micron.

FIGS. 1A and 1B illustrates a prior art diamond-crystal sliding fit holder and mounting method for hard x-ray self-seeding monochromator at the Linac Coherent Light Source (LCLS), at SLAC National Accelerator Laboratory with FIG. 1B providing a detailed view of the prior art diamond-crystal sliding fit holder.

For instance, the diamond crystal for hard x-ray self-seeding monochromator at the Linac Coherent Light Source (LCLS) at SLAC National Accelerator Laboratory is using a 100-micron to 150-micron-thick, very high quality thin diamond-crystal plate with (001) orientation. To minimize the strain in the diamond crystal induced by the holder structure, the diamond-crystal holder was designed to have a precision slot machined on the main body with a trapezoid shape, which is matched with the diamond-crystal shape to prevent the crystal sliding out of the holder. With an optimized sliding fit, the diamond-crystal is held in the holder with a stable and near strain-free condition. The results of LCLS hard x-ray self-seeding project clearly demonstrate self-seeding at Angstrom wavelengths with a factor of 40-50 bandwidth reduction observed with respect to SASE operation.

To overcome the heat transfer limitations of the sliding-fit-type diamond-crystal holder design described above, known diamond optical assemblies have been developed for a beam-multiplexing x-ray monochromator at the LCLS. Manufactured by Technological Institute for Superhard and Novel Carbon Materials (TISNCM), a dedicated crystal mounting method was developed with perforated or non-perforated CVD diamond springs to provide a gentle clamping force between the Type IIa HPHT thin-film diamond (111) crystal and the thick CVD diamond holder base in the range of $\sim 2.4\times10^{-3}$ N to $\sim 1.2\times10^{-2}$ N. With these assemblies installed in the double-crystal monochromator at the LCLS, the capability of splitting the XFEL beam into a pink and a monochromatic branch was demonstrated.

Both the sliding fit mounting method and CVD diamond springs mounting method only provide fixed clamping forces.

A need exist for a mounting apparatus to enable changing the contact force remotely and dynamically to optimize the thermal contact condition with minimized crystal strain in-situ.

It is desirable to provide an enhanced thin-film diamond crystal mounting apparatus.

SUMMARY OF THE INVENTION

Principal aspects of the present invention are to provide a method and mechanical design for thin-film diamond crystal mounting apparatus for coherence preservation x-ray optics with optimized thermal contact and minimized crystal strain. Other important aspects of the present invention are to provide such method and thin-film diamond crystal mounting apparatus substantially without negative effect and that overcome some of the disadvantages of prior art arrangements.

In brief, a method and mechanical design for a thin-film diamond crystal mounting apparatus for coherence preservation x-ray optics with optimized thermal contact and minimized crystal strain are provided. The novel thin-film diamond crystal mounting apparatus mounts a thin-film diamond crystal supported by a chemical vapor deposition (CVD) diamond film spacer, and two groups of thin film thermal conductors, such as thin CVD diamond film thermal conductor groups separated by the thick CVD diamond spacer. The two groups of thin CVD film thermal conductors provide thermal conducting interface media with the thin-film diamond crystal. A piezoelectric actuator is integrated into a flexural clamping mechanism generating a clamping force from zero to an optimal level.

In accordance with features of the invention, the novel thin-film diamond crystal mounting apparatus has been designed and constructed at the Advanced Photon Source (APS) at Argonne National Laboratory with clamping force controls from zero to an optimized level.

In accordance with features of the invention, the thin-film diamond crystal includes a thin-film type-IIa high-pressure high-temperature (HPHT) synthetic diamond-crystal.

In accordance with features of the invention, the thick chemical vapor deposition (CVD) diamond film spacer has a thickness slightly thicker than the thin-film diamond crystal.

In accordance with features of the invention, a thermal compound is added to an interface between the thick CVD diamond film spacer and the thin-film diamond crystal to enhance the interface heat transfer coefficient.

In accordance with features of the invention, the flexural clamping mechanism includes a clamping arm which is mounted on a flexural pivot. On the clamping arm, there is an adjusting screw with lock nut to provide initial clamping force manual setup.

In accordance with features of the invention, the dynamic clamping force acting on the thin-film HPHT diamond-crystal is generated by the piezoelectric actuator through a clamping arm.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

In the following detailed description of embodiments of the invention, reference is made to the accompanying drawings, which illustrate example embodiments by which the invention may be practiced. It is to be understood that other embodiments may be utilized and structural changes may be made without departing from the scope of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In accordance with features of the invention, a method and a mechanical design for thin-film diamond crystal mounting apparatus for coherence preservation x-ray optics with optimized thermal contact and minimized crystal strain. This novel mechanical design can be applied to new development in the field of: x-ray optics cavities for hard x-ray free-electron laser oscillators (XFELOs), self-seeding monochromators for hard x-ray free-electron laser (XFEL) with high average thermal loading, high heat load diamond crystal monochromators and beam-sharing/beam-split-and-delay devices for XFEL facilities and Advanced Photon Source (APS) future upgraded high-brightness coherent x-ray source in the MBA lattice configuration.

Figure 1A:
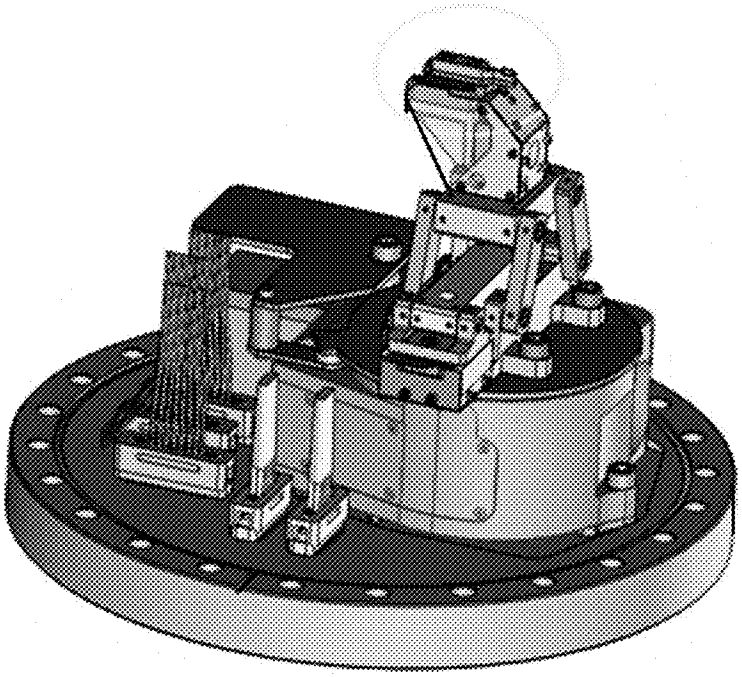
FIGS. 1A and 1B illustrates a prior art diamond-crystal sliding fit holder and mounting method for hard x-ray self-seeding monochromator at the Linac Coherent Light Source (LCLS), at SLAC National Accelerator Laboratory with FIG. 1B providing a detailed view of the prior art diamond-crystal sliding fit holder.
Figure 1B:
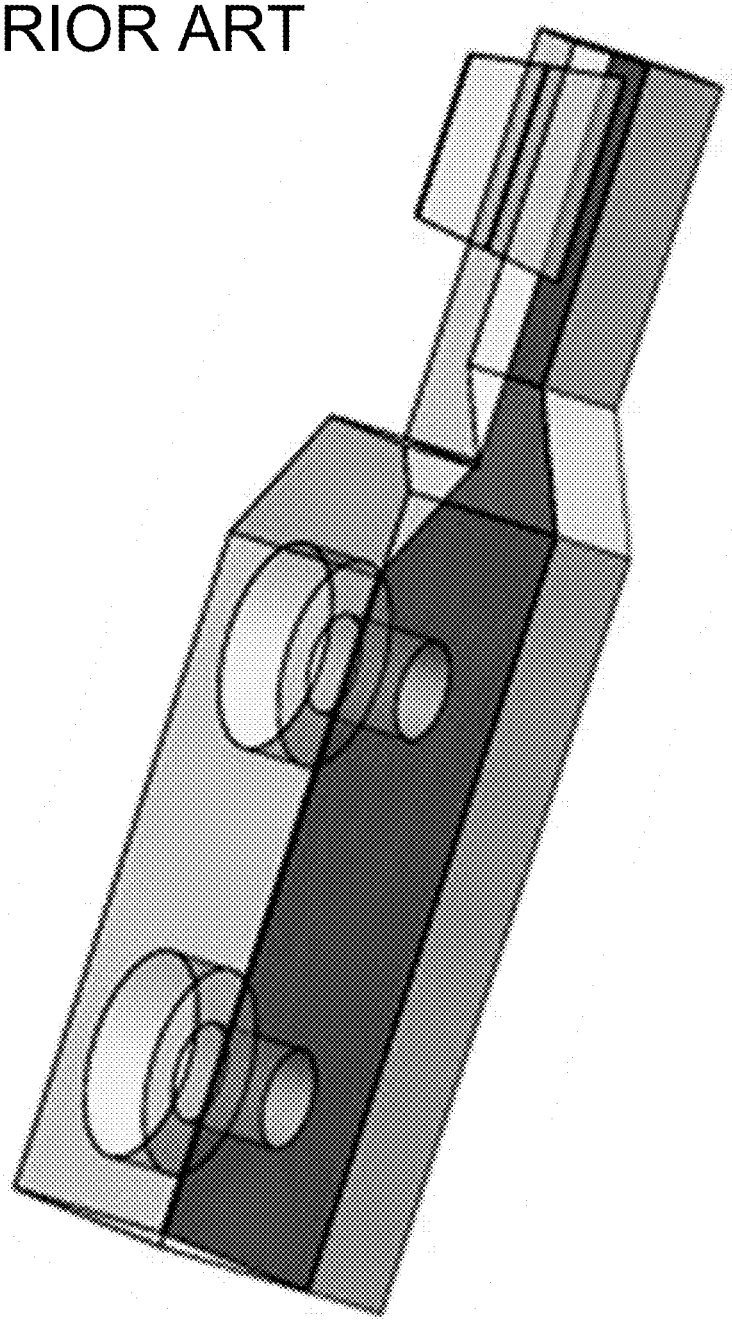
Figure 2:
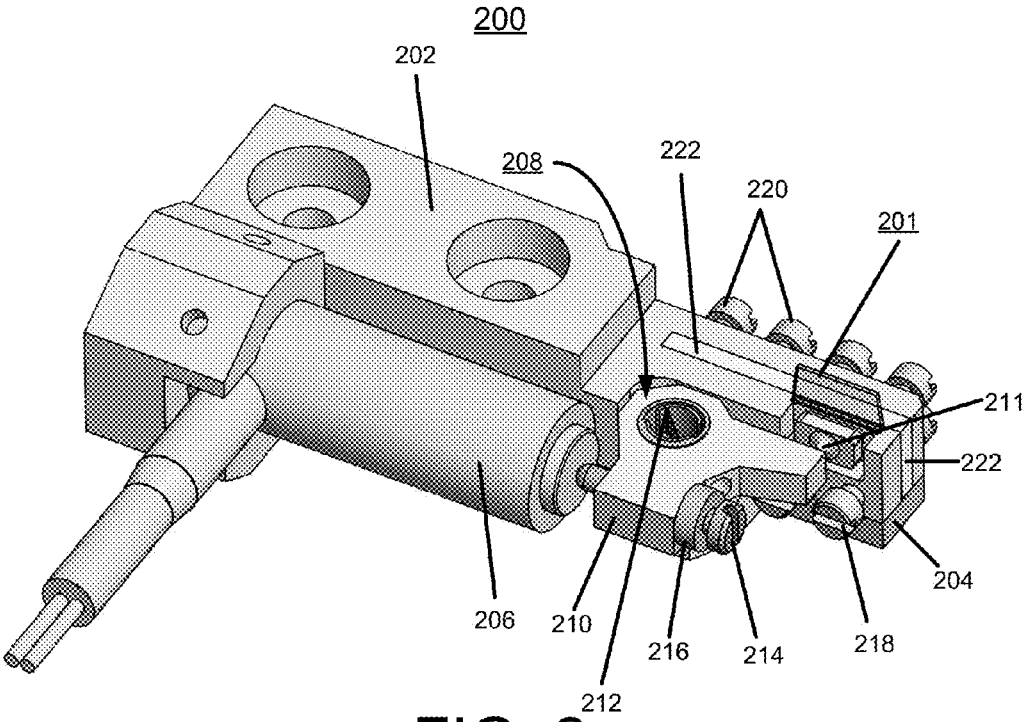
FIG. 2 illustrates a novel thin-film diamond crystal mounting apparatus with dynamic clamping force control to optimize the thermal contact condition with minimized crystal strain in-situ in accordance with preferred embodiments.

Having reference now to the drawings, in FIG. 2, there is shown an example thin-film diamond crystal mounting apparatus for coherence preservation x-ray optics with optimized thermal contact and minimized crystal strain generally designated by the reference character 200 in accordance with the preferred embodiment. The thin-film diamond crystal mounting apparatus 200 mounts, for example, a thin-film type-IIa high-pressure high-temperature (HPHT) synthetic diamond-crystal 201.

The novel thin-film diamond crystal mounting apparatus 200 provides dynamic clamping force control to optimize the thermal contact condition with minimized crystal strain in-situ in accordance with preferred embodiments. A prototype of the novel thin-film diamond crystal mounting apparatus 200 has been designed and constructed at the Advanced Photon Source (APS) with clamping force controls from zero to an optimized level for coherence preservation hard x-ray optics applications. The thin-film diamond crystal mounting apparatus 200 includes a mounting base 202 and a bottom plate 204.

Figure 3A:
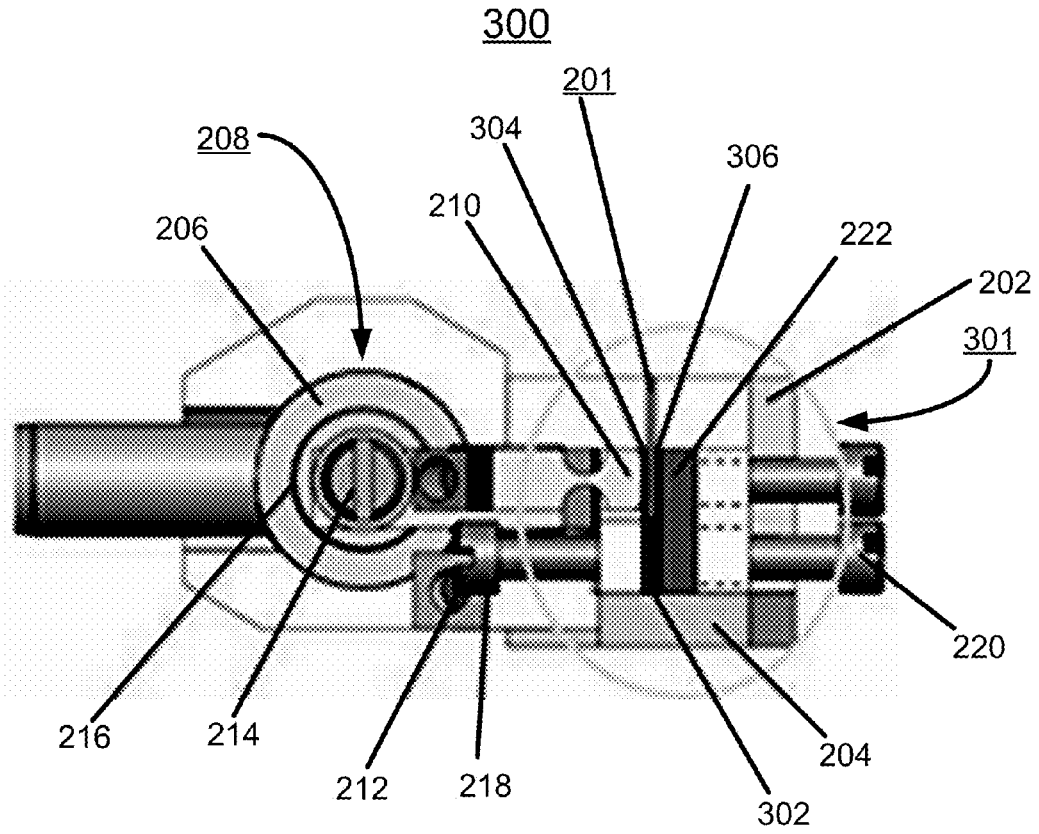
FIGS. 3A and 3B illustrate fragmentary sectional views of the novel thin-film diamond crystal mounting apparatus of FIG. 2 to show that the dynamic clamping force acting on a thin-film HPHT diamond-crystal in accordance with preferred embodiments.
Figure 3B:
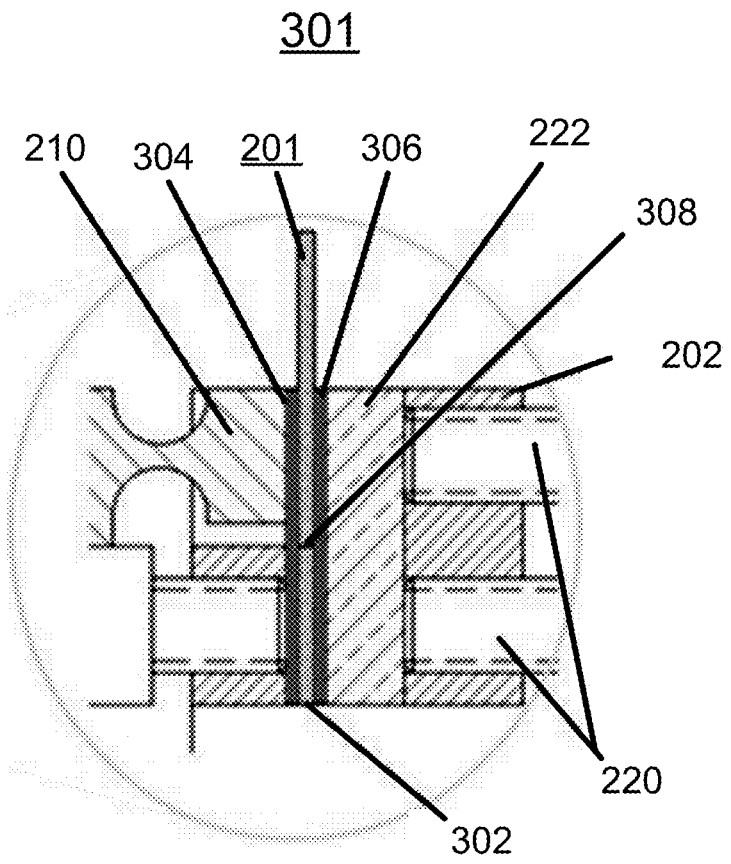
Figure 4A:
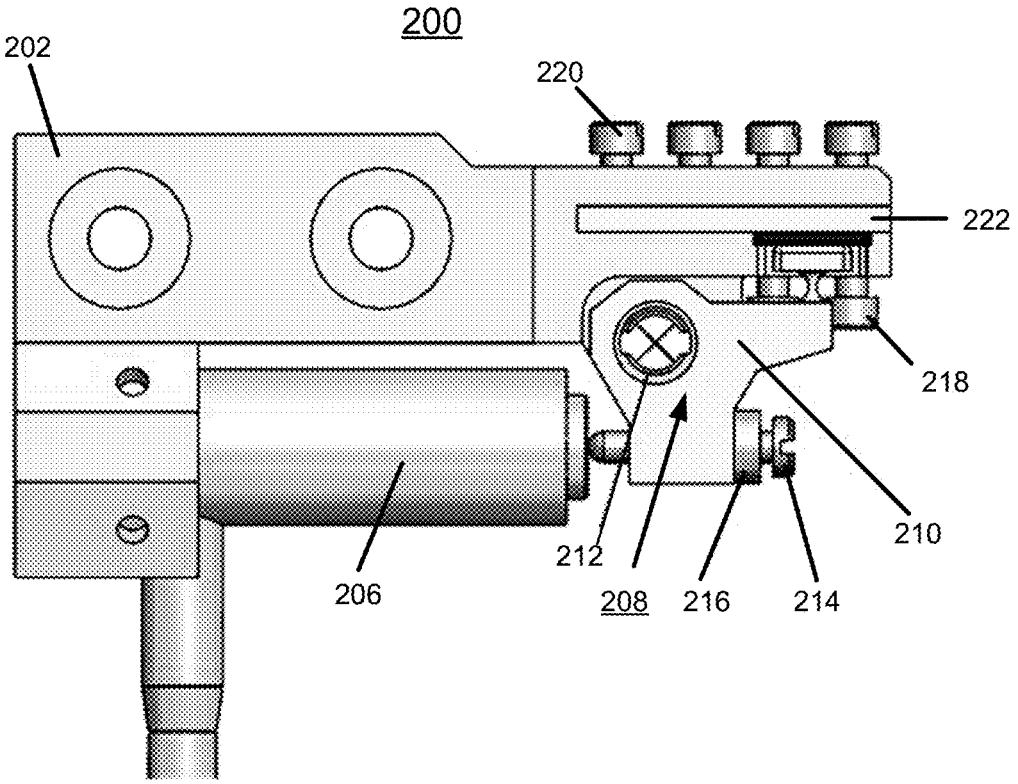
FIGS. 4A, 4B, 4C and 4D illustrate the example novel thin-film diamond crystal mounting apparatus of FIG. 2 in accordance with preferred embodiments.
Figure 4B:
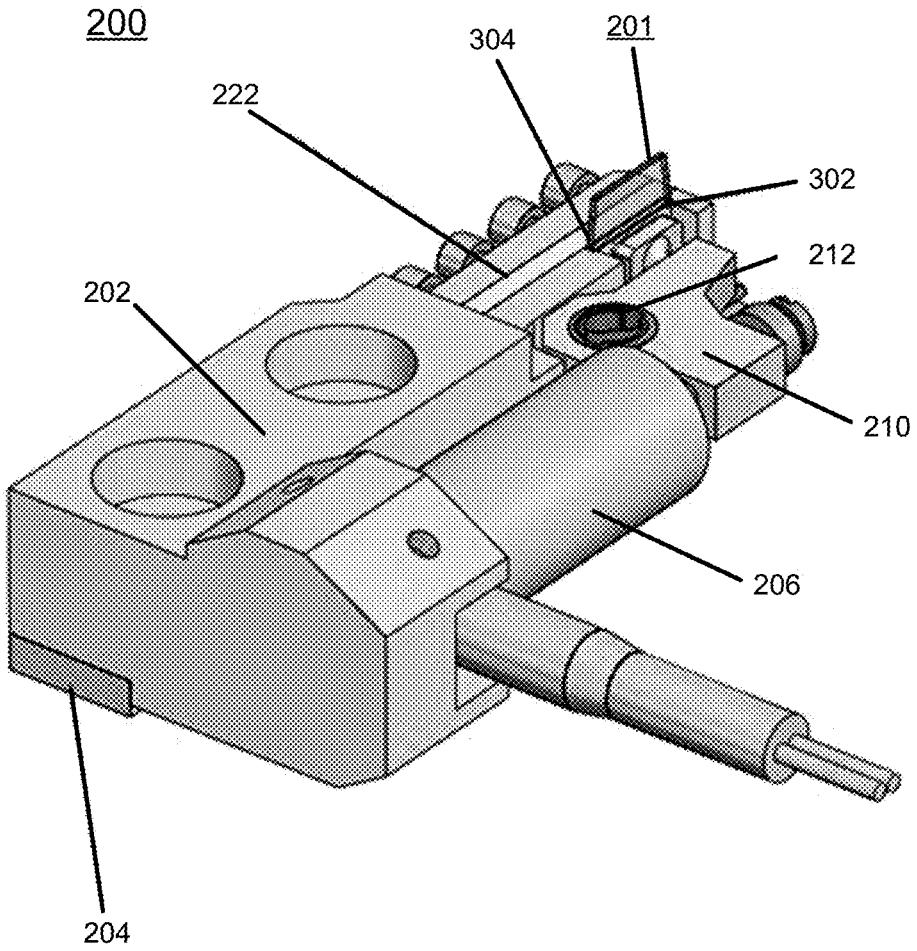
Figure 4C:
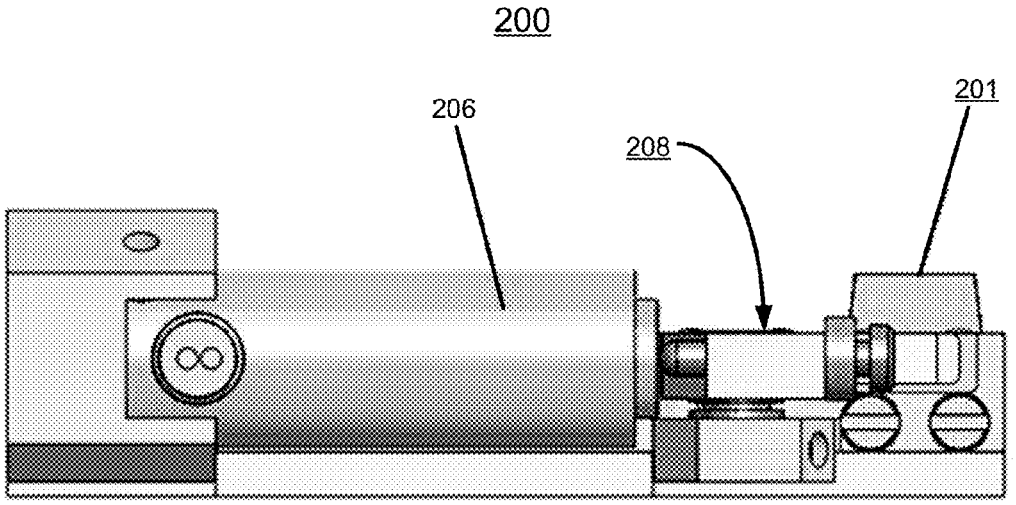
Figure 4D:
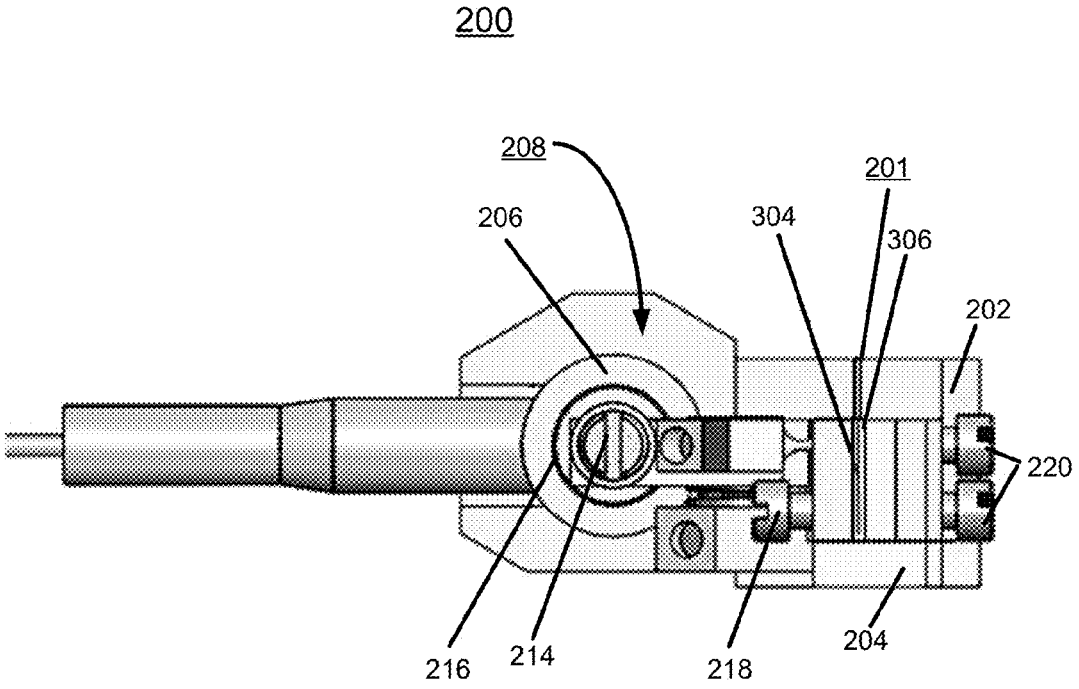

Referring also to FIGS. 3A and 3B fragmentary sectional views respectively generally designated 300, and 301 of the novel thin-film diamond crystal mounting apparatus 200 illustrate the dynamic clamping force acting on a thin-film type-IIa HPHT synthetic diamond-crystal 201 in accordance with preferred embodiments.

As best shown in FIGS. 3A and 3B, the novel thin-film diamond crystal mounting apparatus 200 mounts the thin-film type-IIa HPHT synthetic diamond crystal 201 supported by a thick chemical vapor deposition (CVD) diamond film spacer 302, having a thickness slightly thicker than the thin-film type-IIa HPHT synthetic diamond crystal 201, and two groups of thin film thermal conductors 304, 306, such as thin CVD diamond film thermal conductor groups separated by the thick CVD diamond film spacer 302. The two groups of thin film thermal conductors 304, 306 provide thermal conducting interface media with the thin-film type-IIa HPHT synthetic diamond crystal 201.

A novel feature of this new novel thin-film diamond crystal mounting apparatus 200 is its basic crystal mounting mechanism using the two groups of thin film thermal conductors 304, 306 having thicknesses in the range of 10-20 micron, as thermal conducting and interface media with the thin-film type-IIa HPHT synthetic diamond-crystal 201.

Referring also to FIGS. 4A, 4B, 4C and 4D, the example novel thin-film diamond crystal mounting apparatus 200 is illustrated in accordance with preferred embodiments.

A piezoelectric actuator 206 is integrated into a flexural clamping mechanism generally designated by the reference character 208 generating a clamping force from zero to an optimal level. The dynamic clamping force acting on the thin-film type-IIa HPHT synthetic diamond-crystal 201 is generated by the piezoelectric actuator 206 through a clamping arm 210 engaging contact point 211. The flexural clamping mechanism 208 includes the clamping arm 210 mounted on a flexural pivot 212. The clamping arm 210 is coupled to the piezoelectric actuator 206 with an adjusting screw 214 and a lock nut 216 to provide an initial clamping force manual setup. One or more screws 218 are coupled to the thick CVD diamond film spacer 302 clamp the two groups of thin film thermal conductors 304, 306 with the thick CVD diamond film spacer 302 to a thick CVD diamond thermal conductor 222.

As shown on the right side in FIG. 2 and partially illustrated in FIGS. 3A and 3B, there are eight clamping screws 220 to clamp the thick CVD diamond thermal conductor 222 to the mounting base 202. For example, the piezoelectric actuator 206 is implemented with a SmartAct™ SLC-1720-S linear Piezo nanopositioner manufactured and sold by SmartAct GmbH of Oldenburg, Germany.

As shown in the detailed view 301 in FIG. 3B, an edge interface 308 between mating edges of the thick CVD diamond film spacer 302 includes thin-film type-IIa HPHT synthetic diamond-crystal 201 includes an edge interface 308. In addition to the thermal contact interface between the thin-film type-IIa HPHT synthetic diamond-crystal 201 and the two groups of thin film thermal conductors 304, 306, the thermal interface compound added on the edge interface 308 between the edges of the thin-film type-IIa HPHT synthetic diamond-crystal 201 and the thick CVD diamond film spacer 302 enhances the interface heat transfer coefficient significantly.

Other than the thin film type-IIa HPHT synthetic diamond-crystal 201, and two groups of thin film thermal conductors 304, 306, the choice of the materials to construct the other components of the thin-film diamond crystal mounting apparatus 200 are determined by its operation environment conditions with different applications.

For synchrotron radiation applications operating in an ultra-high-vacuum (UHV) environment condition, the mounting base 202 and bottom plate 204 are made of oxygen-free copper (OFHC) with Nickel and Gold coating. The clamping arm 210 and screws 214, 218, 220 are made of aluminum alloy or stainless steel. Gallium-indium eutectic alloy is added on the edge interface 308 between the thin-film type-IIa HPHT synthetic diamond-crystal 201 and thick CVD diamond film spacer 302 to enhance the interface heat transfer coefficient significantly.

For thin-film diamond crystal mounting apparatus 200 with electron beams nearby applications, such as XFEL self-seeding monochromators with high average thermal loading, high strength graphite, such as Highly Ordered Pyrolytic Graphite (HOPG) or CVD diamond could be used to construct the mounting base 202, bottom plate 204, clamping arm 210, and the like. A Molybdenum radiation shielding cover will be added to protect the piezoelectric actuator 206. Vacuum compatible low-Z-material-based thermal compound is needed to apply on the edge interface 308 between the thin-film type-IIa HPHT synthetic diamond-crystal 201 and thick CVD diamond film spacer 302.

In synchrotron radiation applications with ambient or Helium environment conditions, the mounting base 202 could be made of oxygen-free copper (OFHC) or aluminum alloy. Regular thermal compound could be applied on the edge interface 308 between the thin-film type-IIa HPHT synthetic diamond-crystal 201 and the thick CVD diamond film spacer 302.

While the present invention has been described with reference to the details of the embodiments of the invention shown in the drawing, these details are not intended to limit the scope of the invention as claimed in the appended claims.

What is claimed is:

1. A thin-film diamond crystal mounting apparatus mounting a thin-film diamond crystal for coherence preservation x-ray optics with optimized thermal contact and minimized crystal strain comprising:

a chemical vapor deposition (CVD) diamond film spacer supporting the thin-film diamond crystal;

two groups of thin film thermal conductors separated by the CVD diamond film spacer providing thermal conducting interface media with the thin-film diamond crystal;

a flexural clamping mechanism coupled to the thin-film diamond crystal; and a piezoelectric actuator integrated into said flexural clamping mechanism generating clamping force from zero to an optimal level.

2. The thin-film diamond crystal mounting apparatus as recited in claim 1, wherein said CVD diamond film spacer having a thickness slightly thicker than the thin-film diamond crystal.

3. The thin-film diamond crystal mounting apparatus as recited in claim 1, wherein said two groups of thin film thermal conductors include thin CVD diamond film thermal conductor groups.

4. The thin-film diamond crystal mounting apparatus as recited in claim 1, wherein said two groups of thin film thermal conductors include thin CVD diamond film thermal conductor groups having thicknesses in a range between 10 microns and 20 microns.

5. The thin-film diamond crystal mounting apparatus as recited in claim 1, further comprising a clamping arm, and wherein said piezoelectric actuator being configured to generate clamping force acting on the thin-diamond crystal through said clamping arm.

6. The thin-film diamond crystal mounting apparatus as recited in claim 1, wherein said flexural clamping mechanism includes a clamping arm mounted on a flexural pivot, said clamping arm engaging said piezoelectric actuator and coupling dynamic clamping force acting on the thin-film diamond crystal.

7. The thin-film diamond crystal mounting apparatus as recited in claim 6, wherein said clamping arm includes an adjusting screw with lock nut to provide initial clamping force manual setup.

8. The thin-film diamond crystal mounting apparatus as recited in claim 1, includes a mounting base and a bottom plate.

9. The thin-film diamond crystal mounting apparatus as recited in claim 8, wherein said mounting base and said bottom plate are formed of oxygen-free copper (OFHC) with a coating formed of nickel and gold for synchrotron radiation applications operating in an ultra-high-vacuum (UHV) environment condition.

10. The thin-film diamond crystal mounting apparatus as recited in claim 8, further comprising a thick CVD diamond thermal conductor, and a plurality of clamping screws to clamp said thick CVD diamond thermal conductor to said mounting base.

11. The thin-film diamond crystal mounting apparatus as recited in, claim 10, wherein the plurality of clamping screws are formed of stainless steel.

12. The thin-film diamond crystal mounting apparatus as recited in claim 8, includes a thermal compound added to an interface of said chemical vapor deposition (CVD) diamond film spacer and the thin-film diamond crystal.

13. The thin-film diamond crystal mounting apparatus as recited in claim 8, wherein said mounting base and said bottom plate are formed of oxygen-free copper (OFHC) with nickel and gold coating.

14. The thin-film diamond crystal mounting apparatus as recited in claim 8, wherein said mounting base and said bottom plate are formed of high strength graphite.

15. The thin-film diamond crystal mounting apparatus as recited in claim 8, wherein said mounting base and said bottom plate are formed of an aluminum alloy.

16. A method for implementing thin-film diamond crystal mounting apparatus for coherence preservation x-ray optics with optimized thermal contact and minimized crystal strain comprising:

providing a thin-film diamond crystal;

providing a chemical vapor deposition (CVD) diamond film spacer supporting the thin-film diamond crystal;

providing two groups of thin film thermal conductors separated by the CVD diamond film spacer providing thermal conducting interface media with the thin-film diamond crystal;

providing a flexural clamping mechanism coupled to the thin-film diamond crystal; and providing a piezoelectric actuator integrated into said flexural clamping mechanism generating clamping force from zero to an optimal level.

17. The method as recited in claim 16, wherein providing a chemical vapor deposition (CVD) diamond film spacer supporting the thin-film diamond crystal includes providing said CVD diamond film spacer having a thickness slightly thicker than the thin-film diamond crystal.

18. The method as recited in claim 16, further comprising providing a thermal compound to an edge interface between said CVD diamond film spacer and the thin-film diamond crystal.

* * * * *